United States Patent [19]

Whang

[11] 3,955,937

[45] May 11, 1976

[54] IGNITOR CHARCOAL AND METHOD OF MANUFACTURE THEREOF

[76] Inventor: Kyu Bong Whang, Central P.O. Box No. 5593, Seoul, South Korea

[22] Filed: Oct. 10, 1974

[21] Appl. No.: 513,770

[30] Foreign Application Priority Data

Mar. 29, 1974 Republic of Korea ..... 2016/73

Related U.S. Application Data

[63] Continuation-in-part of Ser. No. 288,983, Sept. 14, 1972, abandoned.

[52] U.S. Cl. ..... 44/17; 44/25; 44/41

[51] Int. Cl.[2] ..... C10L 5/02; C10L 11/00

[58] Field of Search ..... 44/17, 10 R, 10 H, 41, 44/25, 1 C, 1 F

[56] References Cited

UNITED STATES PATENTS

| | | | |
|---|---|---|---|
| 175,550 | 4/1876 | Berghausen | 44/17 |
| 360,917 | 4/1887 | Rook | 44/25 |
| 3,402,031 | 9/1968 | Shick et al. | 44/17 X |
| 3,726,652 | 4/1973 | Schick | 44/17 X |

*Primary Examiner*—Carl F. Dees

*Attorney, Agent, or Firm*—Stevens, Davis, Miller & Mosher

[57] ABSTRACT

A water-proof ignitor charcoal briquette, and the method of manufacture thereof, composed of charcoal and other charred or carbon fuel in powder form, homogeneously mixed with pulp powder impregnated in a solution of nitre such as potassium nitrate, sodium nitrate, potassium permanganate, excluding ammonium nitrate, so as to be capable of sustaining a long-run combustion, is compressed into individual units of various shapes using such combustible binder as resin and other known binders, and is further overcoated with such combustible solutions as resin and other known water-proof and easily ignitable solutions in order to be moisture proof as well as clean handling and at the same time to be readily ignited by a safety match or a cigarette lighter.

1 Claim, No Drawings

IGNITOR CHARCOAL AND METHOD OF MANUFACTURE THEREOF

CROSS-REFERENCE TO RELATED APPLICATION

This application is a continuation-in-part application related to my pending application Ser. No. 288,983, filed Sept. 14, 1972, entitled "WATER-PROOF IGNITION CHARCOAL AND METHOD OF MAKING SAME," now abandoned.

BACKGROUND OF THE INVENTION

1. Field of the Invention

The present invention relates to coal briquettes, particularly to ignitor-briquettes made mainly of charcoal for the purpose of readily starting prime fuels such as coal, charcoal, fuel logs, etc.

2. Description of the Prior Art

Fuel logs, coal, charcoal and other types of briquettes are widely employed for indoor fire place, outdoor cooking and camp fires.

In starting those types of fuel, the application thereto of a flammable liquid such as kerosene, gasoline, benzene and other petroleum products, or an electric starting element are commonly utilized. Each of these methods involves a certain amount of danger, fire hazard and or burn in the case of the petroleum products and electric shock in the case of the electric element, to the individual handling them. The starting fuels such as those indicated above also have the disadvantage of adversely affecting the original taste of the food being cooked, especially so in the case of barbecue cooking, and the electric element is expensive to maintain and operate.

Many attempts and methods have been tried in the past to develop an ignitor fuel of the type by which a kindling fire for prime fuels can be safely started by a simple lighting device such as a safety match or a cigarette lighter, and difficulties of one type or another have been encountered without much resultant success.

Some improvements have been described in U.S. Pat. No. 2,849,300 and U.S. Pat. No. 3,431,093. The former has two components, the starter mix and the combustion sustaining mix; the starter mix being a mixture of ammonium nitrate, carbon and of a burning rate accelerator such as potassium dichromate, and the combustion sustaining mix being a mixture of ammonium nitrate, carbon and of a binding agent, preferably paraffin wax, with or without overcoating thereon of paraffin wax. The latter is made by treating charcoal with a mixture of saturated higher alcohols and saturated higher carboxylic acids, with an overcoating thereon of nitrocellulose.

The imperative factor most desired in the types of ignitor fuel is that the ignition of the fuel be successful on the first attempt under any circumstances, regardless of environmental and weather conditions, and none of the prior ignitor coals was found to be completely satisfactory.

Ammonium nitrate should preferably be avoided for its emission of an extremely noxious gas, nitrous oxide (laughing gas), during the combustion thereof, not to mention its explosive nature. Upon being ignited, even with the addition of potassium dichromate, ammonium nitrate burns quickly with explosive sparklings leaving neither a fire seed nor ember sufficient to kindle itself, and is far from being an ignitor-fuel for the prime fuel.

(See pages 69–70 of the eighth edition of the Merck Index published by Merck & Co., Inc., Rahway, N. J., U.S.A. "Ammonium Nitrate . . . USE: . . . for making nitrous oxide (laughing gas);" see also page 744: "Nitrous Oxide . . . laughing gas; . . . Prepd. by thermal decomposition of ammonium nitrate, . . . Asphyxiant . . . Dissociation begins above 300 degrees when the gas becomes a strong oxidizing agent . . . MED USE: Inhalation anesthetic and analgesic. Human Toxicity Narcotic in high concns. less irritating than other oxides of nitrogen)."

Also, charcoal treated with a mixture of saturated higher alcohols leaves the main body thereof unkindled after an explosive combustion of the overcoating of nitrocellulose.

SUMMARY OF THE INVENTION

Through extensive experiments I made, I have discovered that none of potassium nitrite, sodium nitrite, potassium dichromate, or ammonium nitrate can yield the satisfactory results desired but that potassium nitrate or sodium nitrate alone, or potassium permanganate, can accomplish without failure the functions most required in the types of ignitor fuel of the present invention, i.e., reliable ignition in all environmental and weather conditions, sunny, misty and rainy.

In mixing homogeneously a small amount of solution of nitre, i.e., potassium nitrate or sodium nitrate or potassium permanganate, with a large amount of charcoal powder in accordance with the present invention, technical difficulties would be encountered. It is therefore contemplated that a certain amount of pulp powder in adequate proportion to the charcoal powder to be mixed therewith be first impregnated with the nitre solution, then the nitre-laden pulp powder, after being dried into original powder form, be mixed with the charcoal powder.

Being mixed homogeneously with the charcoal powder by means of a combustible binder such as resin or other known binders and further compressed into briquettes of a certain shape, pulp powder with its tissue-like soft body plus the improved burning properties of the nitre not only constitutes easily ignitable soft spots properly scattered elsewhere in the body of the briquette but also provides, after its being burnt away, air-pockets forming passageways for additional air to be drawn in, thereby accelerating quick and widespread combustion of the entire body of the briquette.

It is therefore a prime object of the present invention to provide a moisture-proof ignitor-briquette capable of being quickly and readily ignited by a match flame.

Another object of the present invention is to provide an ignitor-briquette capable of retaining a lasting coal ember so as to ensure easy starting of the primary fuel.

Still another object of the present invention is to provide safer and convenient means for starting coal, charcoal and fuel logs.

A further object of the present invention is to provide an ignitor-briquette that emits no more disagreeable fumes than that of chacoal itself and far less than those commonly associated with flammable liquids such as kerosene, gasoline and other petroleum products popularly employed in starting the primary fuel.

In the preferred embodiment of the present invention, these objects are satisfactorily accomplished by a mixture for the ignitor-briquette comprising charred or carbon combustibles such as charcoal and charred sawdust homogeneously mixed with soft body combustibles such as pulp, ground sawdust, wooden powder and chopped paper impregnated with a solution of nitre of burning accelerating properties.

The soft body combustibles assisted by the nitre of combustion sustaining properties, being an easily ignitable combustible itself, once ignited, will quickly direct heat ember into the interior of the briquette, thereby turning the latter into a fireball and thus providing a fire base sufficient for the prime fuel to be kindled.

The briquette of this invention is characterized in that, once lit, it retains a lasting coal ember for a much longer time as compared with other combustibles, all by virtue of the charred substance it contains therein.

The above and further features of this invention will be better appreciated from a consideration of the following detailed description of a preferred embodiment thereof.

DESCRIPTION OF THE PREFERRED EMBODIMENT

In embodying the present invention, a certain amount of pulp powder in proper proportion to the amount of charcoal powder to be mixed therewith is placed in the solution of nitre comprising potassium nitrate or sodium nitrate or possibly potassium permanganate, the solution of nitre in water being in the proportion of 1 to 10, allowed to soak in a slurry form for a time sufficient for completion of soaking.

The wet pulp powder then is heated, preferably in a spread form, by heating of up to 70°C. until it drys up and turns into its original form of powder.

However, it is also possible that ground sawdust, wooden powder and chopped paper could be utilized in place of the pulp powder.

In order to secure a homogeneous mixture of a large amount of the charcoal powder with a small amount of the pulp powder for the satisfactory results desired, it is preferable that the pulp powder be sprinkled through screening means onto the charcoal powder spread flat under the screen and then be fed into mixing means to be thoroughly mixed. However, pouring in of a binder solution should not be made at the first stage of the mixing thereof for it might adversely affect the complete mixing.

Next the combustible binder solution prepared by adding alcohol to resin is added to the mixture of the charcoal powder and the pulp powder in the mixer and another thorough mixing takes place.

The composition thus mixed is compressed into individual briquette units of various shapes, as desired.

As a final step, in order to make for cleaner handling, an overcoating of the resin solution or any other suitable known polymer solution is provided on the outer surfaces of the individual ignitor-briquettes formed in the foregoing steps, by known techniques, such as spraying, dipping, etc.

The formulation of the mixture of the preferred embodiment of the present invention is given below:

| | |
|---|---|
| Charcoal Powder | 70% by volume |
| Pulp Powder | 10% " |
| Resin | 20% " |
| Nitre (potassium nitrate)<br>(sodium nitrate)<br>(Potassium permanganate) | 1 by weight |
| Water | 10 |

It should be noted that the specific quantities recited herein are exemplarly only and any suitable proportions of the mixture may be employed which result in the water-proof readily flammable ignitor-briquette of the present invention.

Being flammable as well as moisture proof, the resin coating plays a dual-purpose role in warding off moisture and in being readily ignitable by a match flame.

Placed in the center of a fire bed and lit by a match, the resin coating of the briquette of the invention bursts into flame emitting extremely high heat all around, thereby causing the easily ignitable soft-bodied pulp powder (by virtue of the nitre of burning accelerating properties impregnated therewith and the resin binder for the interior of the briquette) to be ignited.

At this stage of the combustion, substantially readily ignitable soft-spots are formed. Upon the completion of combustion of the nitre-impregnated pulp powder implanted in the briquette, a plurality of air-pockets are formed in the places of the soft-spots once occupied by the nitre-impregnated pulp powder before being burnt away, thereby opening passages for additional air to be drawn in, further facilitating quick and widespread combustion into the interior of the briquette and at the same time assisting the resin binder in propagating the burning, and thus finally turning the briquette as a whole into fireballs of extreme heat sufficient to start the primary fuel.

The charred combustibles combined with the nitre-impregnated pulp powder, constituting the interior of the briquette, retains a lasting coal ember so as to ensure the kindling of the prime fuel, thus making the briquette of the invention a reliable and sure source of ignition.

From the foregoing, it is apparent that the ignitor-briquette of the present invention has distinct advantages over previous ignitors in that it is moisture proof as well as readily ignitable, emits no obnoxious or disagreeable fumes to affect the original taste of food being cooked over and retains a durable coal ember for igniting the prime fuel.

Having fully defined my invention in the foregoing specification, I desire to be limited only by the lawful scope of the following claims, as interpreted according to the spirit and purpose of my invention.

What is claimed is:

1. A method of making ignitor-briquettes, comprising the steps of:

a. immersing a soft-tissue combustible material selected from the group consisting of pulp, ground sawdust, wood powder and chopped paper in an aqueous solution of nitre comprising at least one oxidizing agent selected from the group consisting of potassium nitrate, sodium nitrate, and potassium permanganate;

b. drying said solution;

c. after drying, sprinkling said oxidizing agent-impregnated soft-tissue combustible onto a charred carbon combustible powder material selected from the group consisting of charcoal and charred sawdust spread flat;

d. thereafter mixing said impregnated soft-tissue combustible and said charred carbon powder together;

e. adding to the mixture from step (d) a binder solution of resin;

f. compressing the mixture from step (e) into a substantially solid unit of predetermined shape; and g. applying a coating of said resin solution to the exterior surface of said substantially solid unit from step (f).

* * * * *